US008043114B2

(12) United States Patent
Kaneko et al.

(10) Patent No.: US 8,043,114 B2
(45) Date of Patent: Oct. 25, 2011

(54) REDUCED-HEIGHT WIRE TO BOARD CONNECTOR

(75) Inventors: Tomonari Kaneko, Ebina (JP); Seigo Yoneyama, Yamato (JP)

(73) Assignee: Molex Incorporated, Lisle, IL (US)

( * ) Notice: Subject to any disclaimer, the term of this patent is extended or adjusted under 35 U.S.C. 154(b) by 235 days.

(21) Appl. No.: 11/921,880

(22) PCT Filed: Jun. 9, 2006

(86) PCT No.: PCT/IB2006/004111

§ 371 (c)(1),
(2), (4) Date: Feb. 25, 2011

(87) PCT Pub. No.: WO2007/110699

PCT Pub. Date: Oct. 4, 2007

(65) Prior Publication Data

US 2011/0151708 A1 Jun. 23, 2011

(30) Foreign Application Priority Data

Jun. 9, 2005 (JP) ..... 2005-169942

(51) Int. Cl.
*H01R 12/24* (2006.01)

(52) U.S. Cl. ..... 439/497; 439/468

(58) Field of Classification Search ..... 439/74, 439/70–73, 330–331, 525–526, 497, 468
See application file for complete search history.

(56) References Cited

U.S. PATENT DOCUMENTS

| | | | | |
|---|---|---|---|---|
| 6,692,294 | B2 * | 2/2004 | Kobayashi | 439/496 |
| 6,830,478 | B1 | 12/2004 | Ko | |
| 6,939,164 | B2 * | 9/2005 | Noro | 439/492 |
| 7,309,237 | B2 * | 12/2007 | Kuo | 439/63 |
| 7,377,803 | B2 * | 5/2008 | Matsuoka | 439/497 |
| 7,553,167 | B2 * | 6/2009 | Zhang et al. | 439/74 |
| 7,607,943 | B2 * | 10/2009 | Kenjo | 439/579 |
| 7,828,585 | B2 * | 11/2010 | Kurimoto | 439/468 |
| 7,927,122 | B2 * | 4/2011 | Yamaji et al. | 439/342 |
| 2002/0132518 | A1 | 9/2002 | Kobayashi | |
| 2004/0235340 | A1 | 11/2004 | Noro | |

FOREIGN PATENT DOCUMENTS

| | | |
|---|---|---|
| EP | 1 337 009 A2 | 8/2003 |
| EP | 1 385 232 A | 1/2004 |
| JP | 2005-116447 | 4/2005 |
| WO | WO 2005/043687 | 5/2005 |

OTHER PUBLICATIONS

Search Report of International Application No. PCT/IB2006/004111, Jun. 9, 2006.

Written Opinion of the International Searching Authority for International Application No. PCT/IB2006/004111.

* cited by examiner

*Primary Examiner* — Neil Abrams

*Assistant Examiner* — Phuongchi T Nguyen

(74) *Attorney, Agent, or Firm* — Timothy M. Morella

(57) ABSTRACT

A reduced height wire to board connector assembly includes mating plug and receptacle connectors. The receptacle connector has an internal recess which opens vertically and receives a plug connector therein. Wires are terminated to terminals of the plug connector and they extend out through a wire insertion portion in one of the sidewalls of the receptacle connector. The receptacle connector has a conductive member supported thereby and this fixing member provides a ground connection and a retaining function to the receptacle connector. The plug connector has insulation displacement type terminals and two wire clamps to retain the wires terminated thereto in place.

12 Claims, 9 Drawing Sheets

REDUCED-HEIGHT WIRE TO BOARD CONNECTOR

BACKGROUND AND SUMMARY OF THE INVENTION

The present invention relates to a connector device, and more particularly to an improved wire to board connector of reduced height and improved reliability.

In communications equipment for transferring large volumes of information, such as portable telephones, personal computers and the like, coaxial cables are used for transferring high-frequency signals. A cable-attached plug connector is formed by arranging a large number of such coaxial cables in parallel into a flat shape and attaching a plug connector to an end of the coaxial cables. These cables are terminated, by way of the plug connector, to electronic components mounted on a substrate, such as a circuit board, for processing signals transiting the cables.

There has been a trend toward the miniaturization of communications equipment such as portable telephones, personal computers, and the like. In order to realize miniaturization, there has been an increasingly stringent demand for reduced height, size, and weight of a connector as a component of those equipment. This reduced size may lead to a deterioration in workability. To avoid this, a technique for improving the workability is required.

FIG. 11 shows a known cable plug-style connector I in a condition prior to connection to to a mating connector, taking the form of a receptacle connector 302 which mates with the plug connector 300. In order to connect the two connectors 300, 302 together, the plug connector 300 is moved towards the receptacle connector 302 in parallel to a mounting substrate P. This is commonly referred to as a horizontal type connector device. The coaxial cables C are respectively connected to terminals of the plug connector 300 (the terminals of the plug connector are referred to as plug-side terminals). When the plug connector 300 and the receptacle connector 302 are connected with each other, terminals of the receptacle connector 302 ("receptacle-side terminals") come into contact with the plug-side terminals, allowing electrical signals from the coaxial cables C to flow into electric components (not shown) on the substrate P, on which the receptacle connector 302 is provided.

FIG. 12 is a longitudinal sectional view showing the plug connector 300 as connected to the receptacle connector 302. As shown in FIG. 12, the two connectors are connected with each other while being in close proximity to the substrate P. A blade portion of the plug style connector 300 is received in the receptacle of the receptacle connector 302.

As opposed to the horizontal type connector device as described above, as shown in FIGS. 13 and 14, a connector device of a type in which a plug connector 400 is moved from above towards a receptacle connector 402 mounted on the substrate P to thereby connect the two connectors is referred to as a vertical type connector device. In this vertical type connector device, the plug connector 400 is placed on top of the receptacle connector 402 (it should be noted that the words "upper (top)" and "lower (bottom)" as used herein are taken to mean respectively, the top and bottom sides of the connector as viewed in the drawings.

In the known horizontal-type connector device, the receptacle connector 302 is connected to the plug connector 300, which is flat on the substrate P, while being in close proximity to the substrate P. Accordingly, the horizontal type connector device can be reduced in height as compared with the vertical type connector device in which the plug connector is placed on the receptacle connector. However, the fingers of the operator may touch the substrate P while inserting the plug connector into the receptacle connector, thus hindering the operation or damaging the wiring.

In contrast, in the case of the vertical type connector device, the plug connector 400 is connected from above the receptacle connector 402, so the substrate P does not interfere with the connection and hence good workability is ensured. However, the plug connector 400 is stacked on top of the receptacle connector 402, with the result that the height dimension of the connector device upon connecting the two connectors becomes large, which poses a problem in terms of height reduction.

In view of this, there has been proposed a vertical type connector which not only excels in workability but also enables height reduction. Such a structure is shown in FIGS. 15 and 16. FIG. 15 shows aa plug connector 500 ready for mating to a receptacle connector 502, and FIG. 16 shows the receptacle connector 502 and the plug connector 500 mated together. Formed in the receptacle connector 502 is an upwardly open fitting recess 503 into which the plug connector 500 is fitted from above. Since the plug connector 500 is thus fitted into the receptacle connector 502, it is possible to achieve height reduction while maintaining the advantage of the vertical type connector device, that is, while ensuring good workability in connecting the plug connector and the receptacle connector with each other.

Further, in the receptacle connector 502, there is formed a release hole 510 in the form of a cutout that communicates with the fitting recess 503 so as not to prevent the coaxial cables C from projecting outwards upon connecting the plug connector 500 and the receptacle connector 502 with each other (see FIGS. 15 & 16). The fitting recess 503 is thus open at the top and at the rear. It should be noted that for the sake of convenience, the portion of the receptacle connector 502 in which the release hole 510 is formed is referred to as a cable insertion portion and denoted by reference symbol 502*b*.

In order to ensure reliable connection between the receptacle-side terminals 505 and the plug-side terminals 506, the receptacle-side terminal 505 is shaped so as to generate a contact pressure between the receptacle-side terminal 505 and the plug-side terminal 506 upon abutting against the plug-side terminal 506. The contact pressure also acts as a force for retaining the connection between the plug connector 500 and the receptacle connector 502 (hereinafter refereed to as the connector connection retaining force).

The connector connection retaining force acts to press the plug connector 500 towards the cable insertion portion 502*b* of the receptacle connector 502 upon fitting the plug connector 500 into the fitting recess 503 of the receptacle connector 502. In this regard, the receptacle connector 502 has, at the cable insertion portion 502*b*, the release hole 510 open at the rear as described above. Since the release hole 510 communicates with the fitting recess 503 of the receptacle connector 502, the receptacle connector 502 has the fitting recess 503 that is open at the top and at the rear, so the mechanical strength of the receptacle connector 502 is accordingly weak.

Upon connecting the plug connector 500 and the receptacle connector 502 together, stress concentration resulting from the contact pressure will occur, in particular, at a location of the cable insertion portion 502*b* where the release hole 510 in the form of a cutout is formed and in the vicinity of the location, causing distortion. As a result, there is a fear of the receptacle connector 502 undergoing damaging deformation.

Further, when the coaxial cables C are pried upwards so a force for releasing the connection between the plug connector 500 and the receptacle connector 502 acts on the plug connector 500 and the receptacle connector 502 that have been connected together, the plug connector 500 is detached from the receptacle connector 502, which may hinder the electrical connection of the connector device.

The present invention is directed to a reduced height wire to board connector of the plug style which avoids the shortcomings of the prior art described above.

SUMMARY OF THE INVENTION

It is accordingly, a general object of the present invention to provide a novel structure for a plug connector and a receptacle connector, which reduces deformation of the receptacle connector due to forces exerted during mating and unmating of the plug and receptacle connector.

Another object of the present invention is to provide an improved wire to board connector assembly using a plug connector and a receptacle connector, wherein the receptacle connector includes a receptacle that opens to the top and the plug connector is inserted into the receptacle vertically, without enlarging the height of the connector assembly.

Yet another object of the present invention is to provide a plug connector for use in wire to board connection applications, the plug connector including an insulative housing with a wire-receiving open area into which the ends of a set of wires are positioned, the housing including a first wire clamp formed of insulative material which exerts a termination pressure onto the free ends of the wires to terminate the wires to individual insulation displacement terminals, a second wire clamp formed of conductive material, the second wire clamp engaging the wires and contacting conductive shields thereof so as to common the internal grounds of the wires together, and the plug connector further including an outer, conductive shell that holds the first and second wire clamps in place with the housing and which contacts the second wire clamp and conductive faces of a mating receptacle connector, the outer shell having openings through which conductive portions of terminals of the plug connector extend for mating with an opposing mating connector.

Still another object of the present invention is to provide a receptacle connector for use in wire to board applications, the receptacle connector including an insulative housing with a flat base for attaching to a substrate such as a printed circuit board, the housing including a plurality of terminals the terminals having tail portions for attachment to the circuit board and contact portions that extend along a face of a receptacle defined within the housing, thereby defining a plurality of contact faces for mating with an opposing connector inserted therein, the housing further including a shell that partially covers portions of the housing, the receptacle shell including contact portions for mating with ground contact points on an opposing mating connector.

The present invention accomplishes this and other objects due to its structure. The present invention relates to a connector device including: a connector having a housing provided with a cable and a terminal connected to one end of the cable; and a mating connector to which the connector is connected, the connector device being characterized in that the mating connector includes a mating housing; a mating terminal provided in the mating housing and brought into contact with the terminal of the connector when the mating connector is connected with the receptacle connector, the mating terminal being fixed onto a substrate. A cable insertion portion is formed in the mating connector housing in opposition to a location where the mating terminal is disposed, the cable insertion portion being a portion through which the cable is inserted; and means for fixing the cable insertion portion to a substrate.

The portion of the mating housing where the cable insertion portion is formed exhibits poor strength as compared with other portions thereof where no such insertion portion is formed. For this reason, upon connecting the connector to the mating connector, stress concentration resulting from a contact pressure due to the connection occurs at the location of the mating connector corresponding to the above portion. In this regard, however, the cable insertion portion is fixed to the substrate by the fixing means, thereby achieving enhanced strength.

Further, the fixing means may be characterized by including a support portion that is abutted against or embedded in the cable insertion portion to support the cable insertion portion, and a firmly fixing portion formed integrally with the support portion and soldered onto the substrate. The cable insertion portion is supported by the support portion and thus enhanced in its strength. In addition, the cable insertion portion thus enhanced in strength is soldered onto the substrate by means of the firmly fixing portion, whereby the cable insertion portion is further enhanced in its strength.

At least one of the connector and the mating connector may have a latching portion that is latched onto the other connector upon connecting the two connectors. The connector and the mating connector are locked to each other by the latching portion, thereby making it possible to prevent detachment of the two connectors from each other.

Further, it is preferable that the latching portion be elastic in strength for latching onto the connector or the mating connector, and an opening into which the elastic member is fitted is formed in either the mating connector or the connector. The latching of the elastic member onto the connector or the mating connector makes the connection between the connector and the mating connector secure. Further, the force with which the elastic member is latched onto the connector or the mating connector increases due to the elasticity of the elastic member. Further, with the opening being thus formed, the elastic member is fitted into the opening, whereby the degree of latching is enhanced to achieve secure locking.

Further, it is preferable that the fixing means be formed of a metal member for causing noise flowing in the cable upon connecting the connector to the mating connector to flow to the ground. The mating housing may also include a metal plate for causing electrical noise flowing in the cable to flow directly to a ground, rather than a signal connection with the fixing means being formed on the metal plate. In addition, it is also conceivable to form the latching portion in a part of the metal plate.

According to the present invention, the cable insertion portion corresponds to a location of the mating connector where, upon connecting the connector to the mating connector, stress concentration occurs due to the connection, and is fixed onto the substrate by the fixing means, whereby the strength of the cable insertion portion can be enhanced. As a result, even when stress develops in the mating connector due to contact pressure between the terminals when the connector and mating connector are mated together, it is possible to effectively prevent the cable insertion portion and, by extension, the housing from undergoing deformation.

Further, the connector and the mating connector are locked to each other by the latching portion to thereby prevent detachment of the two connectors from each other. Accordingly, even when, after connecting the connector and the mating connector with each other, a force for releasing this connection acts on the two connectors, it is possible to prevent detachment of the connector and the mating connector from each other.

Further, by forming the fixing means as a metal plate so as to allow the noise flowing in the cable to flow to the ground, the applicability of the fixing means can be increased.

These and other objects, features and advantages of the present invention will be clearly understood through a consideration of the following detailed description.

BRIEF DESCRIPTION OF THE DRAWINGS

In the course of this detailed description, the reference will be frequently made to the attached drawings in which.

DETAILED DESCRIPTION OF THE PREFERRED EMBODIMENTS

Figure 1:
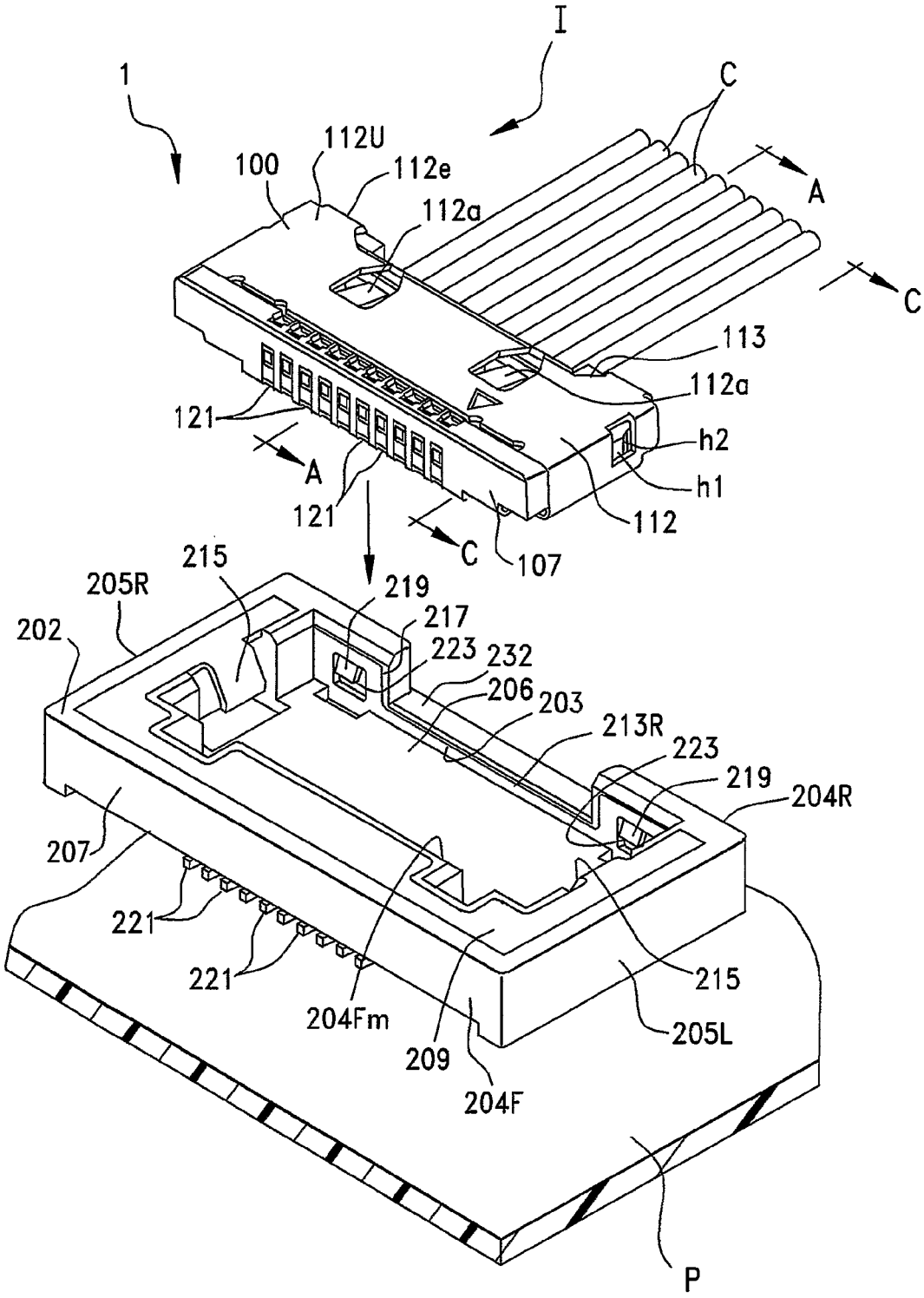
FIG. 1 is an exploded perspective view, as seen from front and diagonally above, of a vertical type connector device constructed in accordance with the principles of the and shown in a state prior to connection between a receptacle connector and a plug connector.
Figure 2:
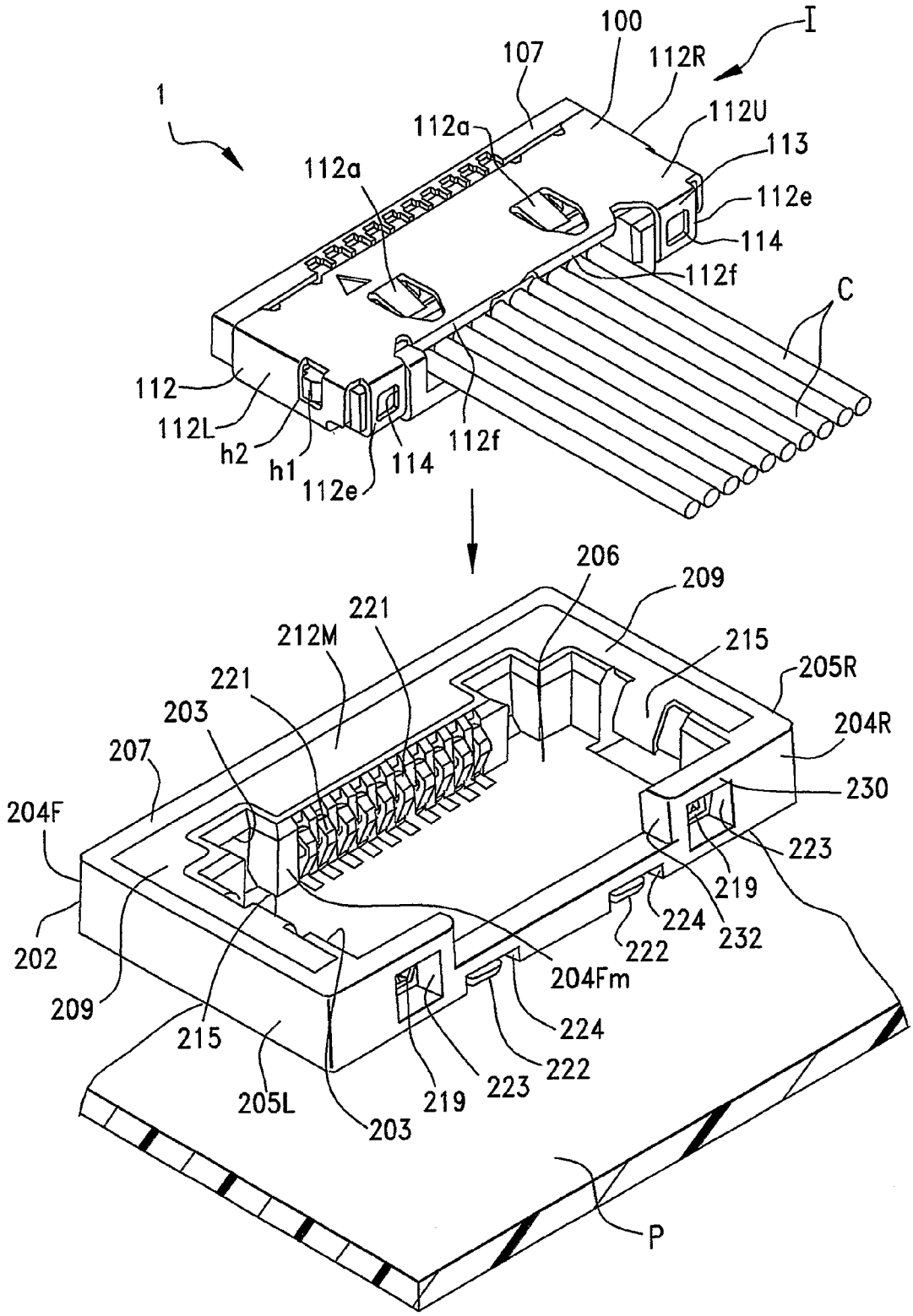
FIG. 2 is an exploded perspective view, as seen from rear and diagonally above, of the connector device according to the present invention in the state prior to the connection between the receptacle connector and the plug connector is made.
Figure 3:
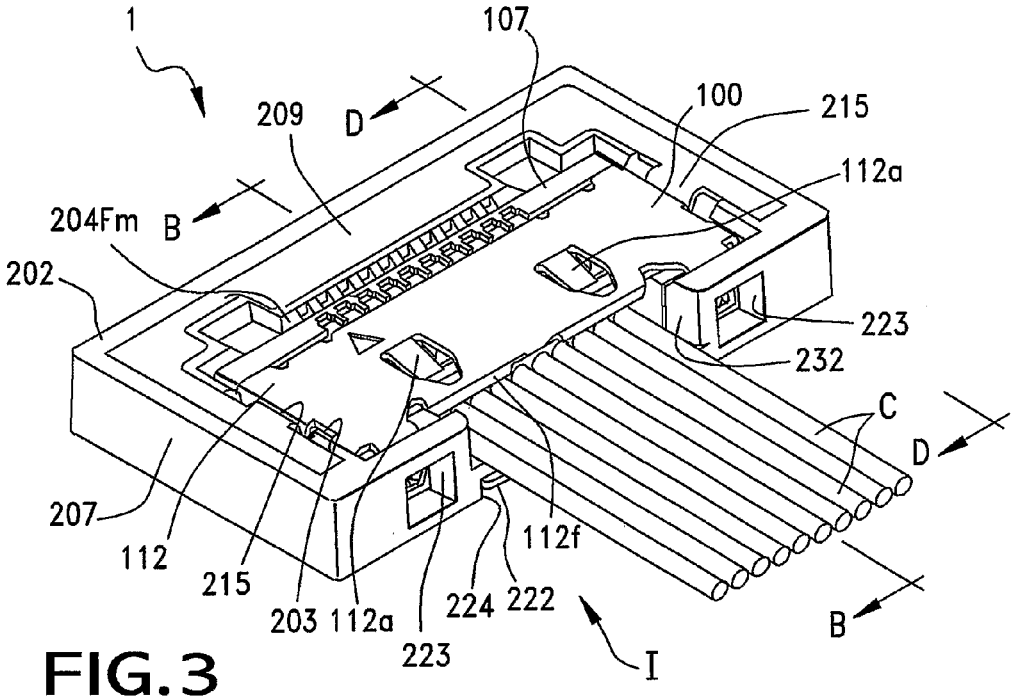
FIG. 3 is a perspective view showing a state in which the receptacle connector and the plug connector in the state as shown in FIG. 2 have been connected with each other.

FIGS. 1-3 illustrate a vertical type connector device 1, in which the connection is effected by fitting a plug connector 100 of a cable-attached plug connector I to a receptacle connector 202 attached onto a substrate P.

Figure 6:
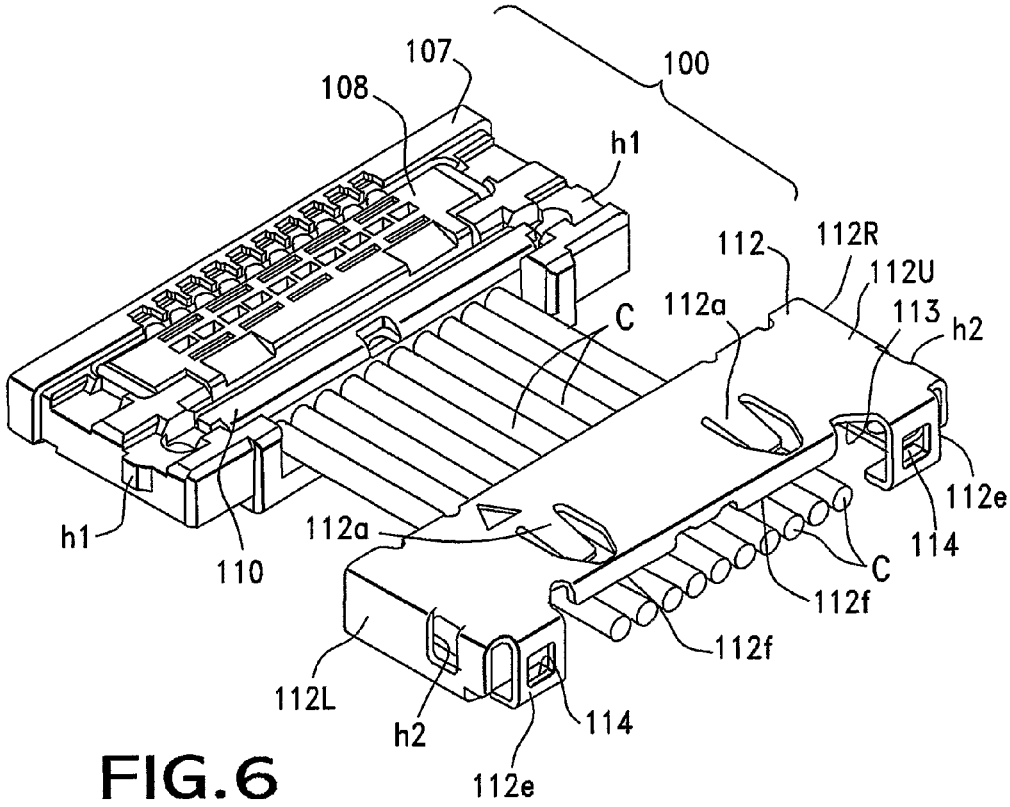
FIG. 6 is a perspective view showing a state prior to covering a housing of the plug connector with an upper shell.
Figure 4:
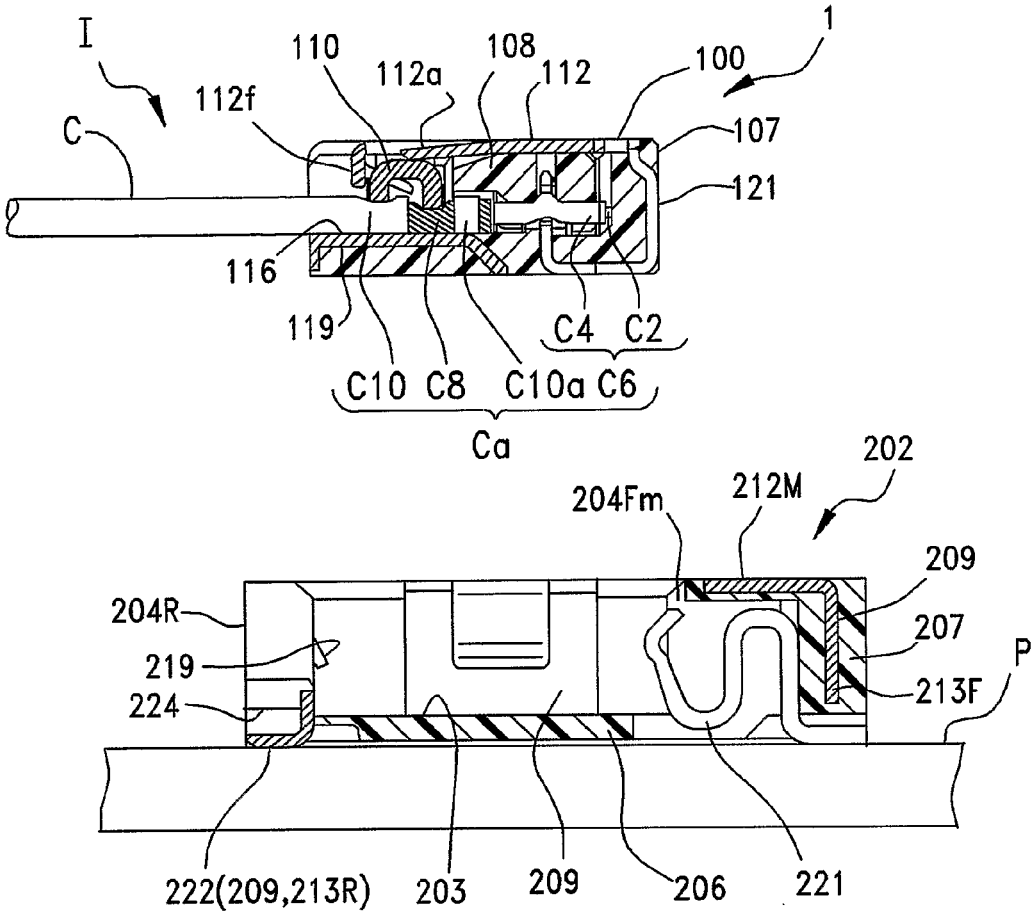
FIG. 4 is a sectional view taken along a line A-A of FIG. 1.

As can be seen from, for example, FIGS. 1, 4, 6, and the like, the plug connector 100 has a plug housing 107, and an upper shell 112 that covers portions of the plug housing 107 to hold components inside the housing. The upper shell 112 also serves as a shield to cause electrical noise flowing in the coaxial cables C to flow to a ground, and is formed of a conductive material such as metal. The plug housing 107 is formed of synthetic resin or other such insulating material. Further, as can be seen from FIG. 1, a plurality of plug-side terminals 121 that are connected with the coaxial cables C are arranged side-by-side along the front edge portion of the plug housing 107.

Figure 5:
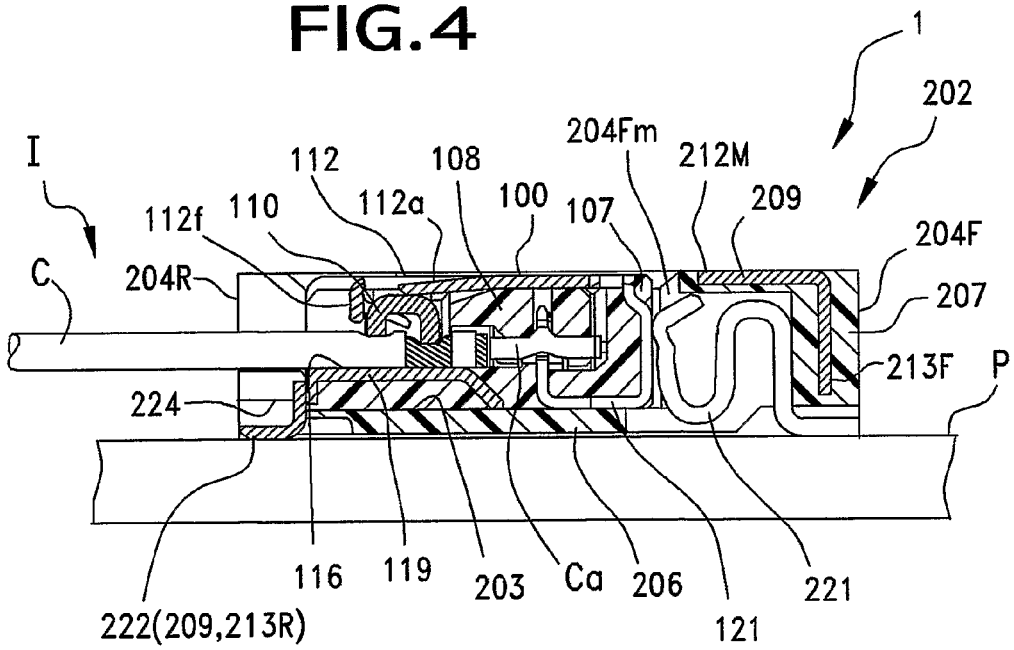
FIG. 5 is a sectional view taken along a line B-B of FIG. 3.

As shown best in FIGS. 4 and 5, each plug-side terminal 121 has an upwardly open rectangular shape when seen from the side. The plug-side terminals 121 are insulation displacement terminals and are partially exposed on the front edge of the plug housing 107 so that they come into contact with the receptacle-side terminals 221 of the receptacle connector 202 when the plug connector 100 and the receptacle connector 202 are mated together.

As shown in FIG. 4, each coaxial cable C is composed of a signal line C6 composed of a centrally located inner conductor C2 covered with an inner insulator C4, an outer conductor C8 composed of a number of metal wires longitudinally aligned, spirally wound, or braided and provided so as to cover the signal line C6, and an outer insulator C10 covering the outer conductor C8. A distal end portion Ca of the coaxial cables C connected to the plug-side terminals 121 is composed of a section where the outer insulator C10 and the outer conductor C8 are both stripped off to leave the signal line C6 exposed, a sheath-remaining portion C10*a* situated immediately rear of this section and where the outer insulator C10 remains, and a section situated immediately rear of the sheath-remaining portion C10*a* and where only the outer insulator C10 is stripped off to leave the outer conductor C8 exposed.

The plug housing 107 includes a recess 116 that is open at the top and at the rear (see FIGS. 4 & 5). Fitted into the recess 116 are a first cable holder, or clamp 108, and a second cable holder, or clamp 110, which hold the distal end portions Ca of the plurality of coaxial cables C while transversely crossing the same. The first cable holder 108 is a plate-like member attached to a forward portion of the recess 116 (FIGS. 4-6). When attached to the plug housing 107, the first cable holder 108 holds the inner insulator C4 of the signal line C6 of each coaxial cable C while pressing it down from above. In holding the signal line C6 by the first cable holder 108, when the first cable holder 108 is attached onto the recess 116, due to the pressing force acting at this time, the inner insulator C4 of the coaxial cable C is torn off as it is pressure-welded onto the plug-side terminal 121, leaving the inner conductor C2 exposed, and the thus exposed inner conductor C2 and the plug-side terminal 121 are electrically connected with each other.

The second cable holder 110, which is shaped like a hollow bar with an inverted U-shaped cross section and is formed from a conductive material, preferably metal, is located rear of the first cable holder 108. Further, when the second holder 110 is attached onto the recess 116, due to the pressing force acting at this time, the outer conductor C8 and the outer insulator C10, which is located immediately rear of the outer conductor C8, at the distal end portion Ca of each coaxial cable C, are sandwiched from above and below between the second cable holder 110 and the plug housing 107. (FIGS. 4-6.)

Further, the plug housing 107 has a conductive insert 119 (FIGS. 4-5) arranged at a location within the recess 116, opposed to the second cable clamp 110. The insert 119, which is made of a material having excellent conductivity such as metal, is integrated into the plug housing 107 and is electrically connected with the outer conductor (ground shield) C8 of every coaxial cable C. In this manner, the outer ground shields of the coaxial cables are all commoned together, and as explained in detail below, they are connected to the conductive shell 112 of the plug connector.

As shown in FIGS. 4 and 5, when the plug connector 100 is connected to the receptacle connector 202, the insert 119 is brought into contact with a rear edge surface 213R of a metal plate 209 of the receptacle connector 202. It should be noted that the insert 119 may not necessarily be formed integrally with the plug housing 107 such as by insert or over molding, but may be located in its position by press-fitting or adhesion.

As shown in FIG. 6, the upper shell 112 that covers the plug housing 107 has a rectangular upper wall 112U, and left and right side walls 112L, 112R bent in a L-shaped configuration with respect to the upper wall 112U. The upper, side, and lower surfaces of the plug housing 107 are partially held by the upper wall 112U and the side walls 112L, 112R.

An engagement window, or slot h2, is formed in each of the side walls 112L, 112R (FIGS. 1, 2, & 6) of the plug connector 100. Upon covering the plug connector housing 107 with the upper shell 112, the engagement window h2 engages a lug or protruding engaging member h1 on the side edges of the plug housing 107. The engagement of the engagement window h2 with the engaging member h1 prevents detachment of the upper shell 112 from the plug housing 107. A pair of bent members 112*a* are bent inwards and are formed in the upper wall 112U. The bent members 112*a* contact with the second cable clamp 110 when the plug housing 107 is covered with the upper shell 112 (FIG. 5), thereby causing any electrical noise flowing in the outer ground conductor C8 of each coaxial cable C to flow through the upper shell 112 eventually to a ground via the second cable clamp 110. The route for removing the noise will be described in detail later in the section on operational effects.

Figure 8:
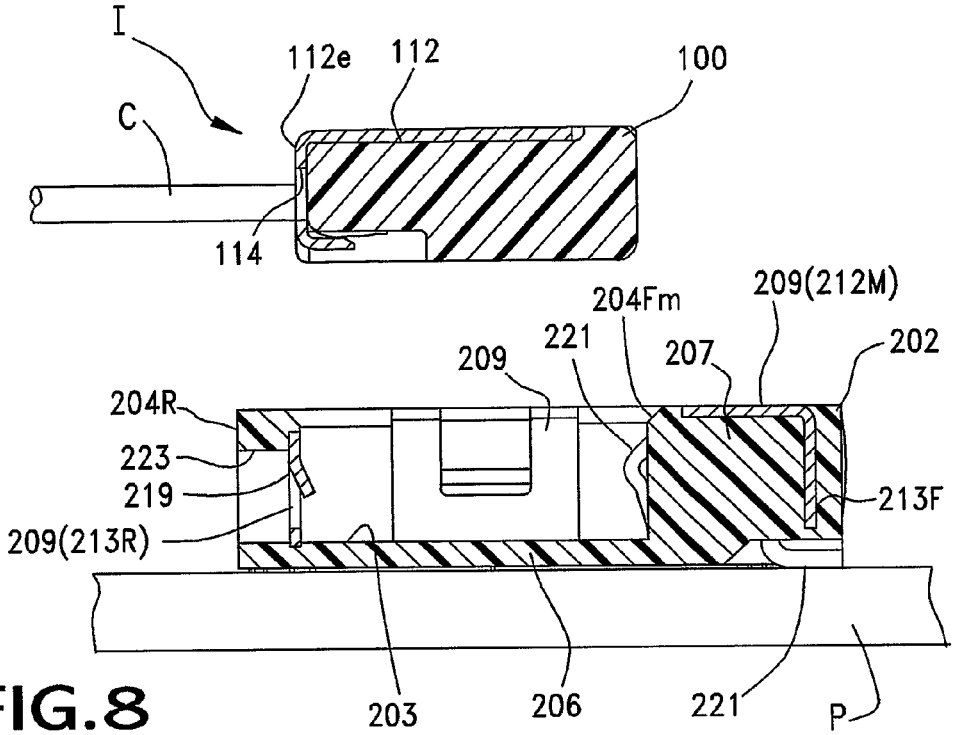
FIG. 8 is a sectional view taken along a line C-C of FIG. 1.

A folded portion 112*e* that has an L-shaped configuration is formed in each of the left and right end portions along the rear edge of the upper wall 112U (FIG. 6). The folded portion 112*e* also has an opening 114 that is formed in its rear surface. (FIGS. 6 & 8.) A pair of downwardly extending members 112*f*, are formed in the portion of the rear edge of the upper wall 112U of the upper shell 112 between the folded portions 112*e* and are folded downwards to be somewhat shorter than the folded portion 112*e*. By forming the downwardly extending members 112*f*, a cutout portion 113 is formed at the central portion of the rear edge of the upper wall 112U of the upper shell 112 in approximately the middle of rear edge of the housing.

It should be noted that in attaching each coaxial cable C to the plug connector 100, the outer sheath at the distal end portion Ca of the coaxial cable C is stripped off in advance to leave the signal line C6 and the outer conductor C8 exposed. (FIGS. 4 & 5.) The outer sheath of the signal line C6 is composed of the outer conductor C8 and the outer insulator C10, and the outer sheath of the outer conductor C8 is composed of the outer insulator C10.

Next, the receptacle connector 202 of the present invention will be described with reference to FIGS. 1-5 and the like. The receptacle connector 202 has a receptacle housing 207 having a flat rectangular-parallelepiped configuration as a whole, and a metal plate 209 is provided as part of the receptacle housing 207. The receptacle housing 207 is formed of synthetic resin or other such insulative material. Further, the receptacle housing 207 has in its central portion a recess 203 in which the plug connector 100 is received to mate the two connector components together.

The recess, or receptacle 203, is formed in the housing and is surrounded by a walls, including front edge wall 204F and rear edge wall 204R which are respectively located in the front and rear. A left edge wall 205L and a right edge wall 205R which connect to the front and rear edge walls 204F and 204R define the other two sides of the recess, while a bottom plate, or floor 206, complete the recess 203. A release hole 232 is formed at the central portion of the rear long edge wall 204R and communicates with the recess 203 and is preferably formed as a rectangular cutout. Therefore, the fitting recess 203 is open at the top of the receptacle housing and along the rear edge thereof. (FIG. 2.)

The release hole 232 is provided so as to permit the cables C to project out of the connector assembly when the plug connector 100 is mated with the receptacle connector 202. The length dimension of the release hole 232 is formed to be slightly larger than the width of all of the cables C of the cable-attached plug connector I. The portion of the rear long edge wall 204R where the release hole 232 is formed is herein referred to as a cable insertion portion. The planar configuration of the fitting recess 203 is also determined by the configuration of the metal plate 209 described below in detail. It should be noted that a stippling is present in the drawings as applied to the metal plate 209 for purposes of clearly indicating the metal plate 209.

Figure 7:
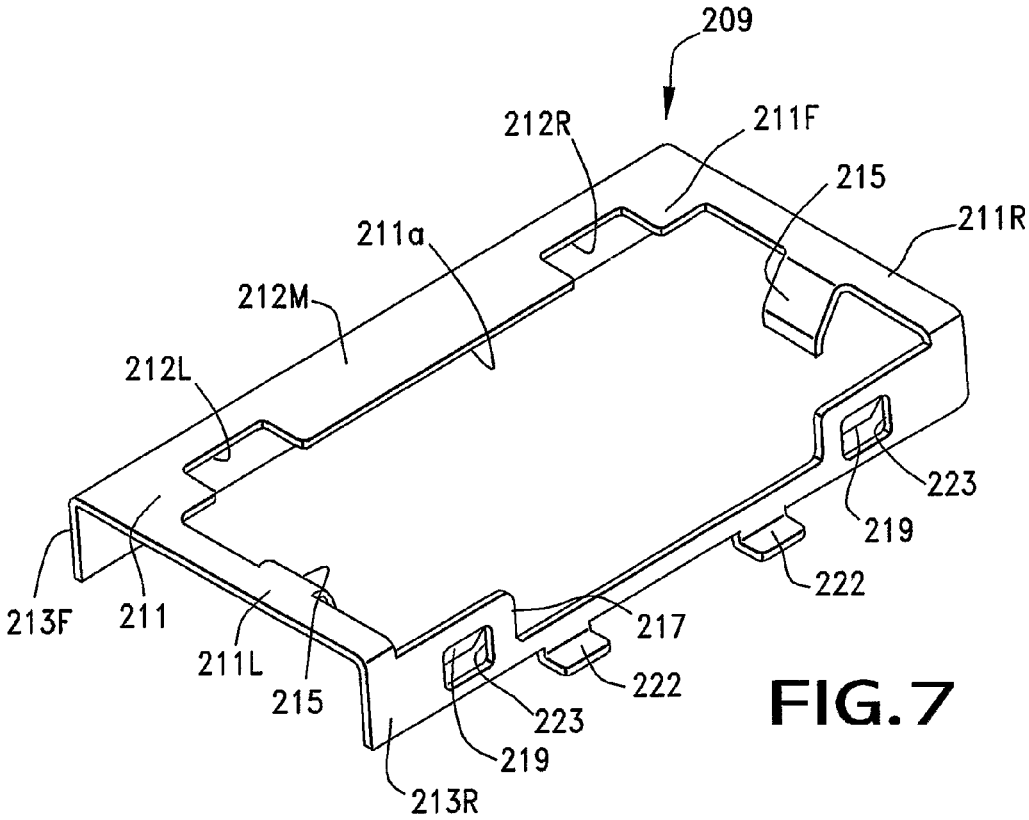
FIG. 7 is a perspective view of a metal plate as seen from rear and diagonally above.

As shown in FIG. 7, the metal plate 209 has an elongated square shape as seen in plan view, with a large opening being formed at the center thereof. A pair of opposing long sides of the metal plate 209 are folded so that the end face of the metal plate 209 is flat inverted-U shaped (it should be noted that the above-mentioned opening is denoted by reference symbol 211*a*). The metal plate 209 is composed of a principal surface 211 having the opening 211*a*, a front edge surface 213F, and a rear edge surface 213R. The opening 211*a* may be formed by punching or stamping. Of the principal surface 211, the other long edge and remaining short edges thereof excluding one long edge are regarded as remaining portions having a predetermined width, respectively renamed as a front remaining portion 211F, a left remaining portion 211L, and a right remaining portion 211R.

The front remaining portion 211F has rectangular cutouts 212L, 212R formed near the opposite ends thereof, and the portion of the front remaining portion 211F between the cutouts 212L, 212R constitutes a central portion 212M. Further, inwardly dangling edge members 215 are respectively formed at opposing positions of substantially central portions of the left remaining portion 211L and right remaining portion 211R. The left and right edge members 215 are the portions that come into contact with the left and right side walls 112L, 112R of the upper shell 112 of the plug connector 100 when the receptacle connector 202 and the plug connector 100 are connected together. (FIGS. 2 & 3.) The edge members 215 are elastic and return to their original position after any pressing pressure is released as when the connectors are unmated.

In the rear edge surface 213R of the metal plate 209, a rectangular cutout 217 is formed by punching so that the central portion of the rear edge surface 213R is upwardly open. An inwardly bent member 219 that is folded inwards is formed at either end portion of the rear edge surface 213R. The size and configuration of the cutout 217 are determined in conformity with those of the release hole 232 in the rear long edge wall 204R of the receptacle housing 207. The rear edge surface 213R serves to reinforce the rear long edge wall 204R to enhance the strength of the same.

As can be seen from FIG. 8, the inwardly bent member 219 is a cantilevered metal member which is inwardly folded and which is fixed at one end and free at the other end. Accordingly, the inwardly bent member 219 exhibits elasticity when an external force is applied onto its distal end side upon connecting the plug connector 100 to the receptacle connector 202. The inwardly bent portion 219 is positioned such that it is opposed to the opening 114 formed in the folded portion 112*e* of the upper shell 112 upon connecting the plug connector 100 to the receptacle connector 302. Therefore, upon connecting the plug connector 100 to the receptacle connector 302, the inwardly bent member 219 is latched onto the opening 114 due to its above-mentioned elasticity. The inwardly bent member 219 is thus referred to as a latching portion.

Further, at the lower edge of the rear edge surface 213R of the metal plate 209, a pair of outwardly bent members 222 that are folded outwards are integrally formed with the lower edge corresponding to the opposite end portions of the cutout 217. As seen in the state as shown in FIG. 4, the portion of the rear edge surface 213R including each outwardly bent member 222 has a horizontally flipped L-shaped configuration in cross section.

The receptacle housing 207, in which the metal plate 209 having the configuration as described above is to be disposed, is formed through integral molding involving sealing the metal plate 209 with synthetic resin and other insulating material such that the rear edge surface 213R of the metal plate 209 is opposed to the inner surface of the rear long edge wall 204R of the receptacle housing 207, the front edge surface 213F of the metal plate 209 is opposed to the front long edge wall 204F of the receptacle housing 207, and that the opposite ends of the metal plate 209 are respectively opposed to the left short edge wall 205L and right short edge wall 205R of the receptacle housing 207.

It should be noted that the metal plate 209 need not be held in the receptacle connector by insert or over molding, but it may be attached to the receptacle housing 207 by press-fitting or adhesion. Preferably, the receptacle housing 207 and the metal plate 209 abut each other. The rear edge surface 213R abuts the outer surface of the rear long edge wall 204R of the receptacle housing 207 or it may be embedded in the rear long edge wall 204R. Further, in the rear long edge wall 204R of the receptacle housing 207 in which the metal plate 209 is disposed, an opening 223 is formed in the portion of the rear long edge wall 204R corresponding to the inwardly bent member 219 (FIGS. 2 & 3), and recesses 224 that are open at the bottom and at the rear are formed in the portion of the rear edge wall 204R corresponding to the pair of outwardly bent portions 222.

Further, in the front edge wall 204F of the receptacle housing 207, the portion thereof corresponding to the central portion 212M of the metal plate 209 is formed so as to allow the receptacle-side terminals 221, which have a horizontally flipped S-shaped configuration in side view, to be arranged in parallel along the long edge of the receptacle housing 207 (FIGS. 2, 4 & 5). The above portion is referred to as a receptacle-side terminal placing portion and denoted by reference symbol 204Fm.

The number of the receptacle-side terminals 221 to be arranged in the receptacle-side terminal placing portion 204Fm is the same as the number of the plug connector terminals 121. Further, the length of the release hole 232 formed in the rear long edge wall 204R of the receptacle housing 207 is set substantially in conformity with the length dimension (taken in the right-to-left direction) of the receptacle-side terminal placing portion 204Fm in which the plurality of receptacle-side terminals 221 are arranged in parallel.

Upon connecting the plug connector 100 and the receptacle connector 202 together, the receptacle-side terminals 221 and the plug-side terminals 121 are brought into pressure contact with each other, so the receptacle-side terminals 221 are compressed in the longitudinal direction by the pressurizing force from the plug-side terminals 121 (see FIGS. 4, 5). Further, since the receptacle-side terminals 221 have an S-shaped configuration, they exhibit elasticity when compressed, thereby generating a contact pressure between them and the plug-side terminals 121. The contact pressure acts as a connector connection retaining force to thereby retain the connection between the plug connector 100 and the receptacle connector 202.

Prior to the connection of the plug connector 100 and the receptacle connector 202 with each other, the receptacle connector 202 is first attached onto the substrate P. In effecting this attachment, the receptacle-side terminals 221 are soldered to appropriate pads or contacts on the substrate P and the pair of outwardly bent members 222 are soldered onto the substrate P and firmly fixed in place. Accordingly, electrical noise propagating through the outer conductor C8 of each coaxial cable C when connecting the plug connector 100 and the receptacle connector 202 together, as well as the electrical noise generated from components connected to the substrate P are removed along a ground path from the outer conductor C8—the second cable holder 110—the pair of bent members 112*a* of the upper shell 112—the upper wall 112U—the left and right side walls 112L, 112R—the left and right edge members 215 of the metal plate 209—the left remaining portion 211L (or the right remaining portion 211R) of the metal plate 209—the rear edge surface 213R—the outwardly bent member 222—and then to the substrate P.

Figure 10:
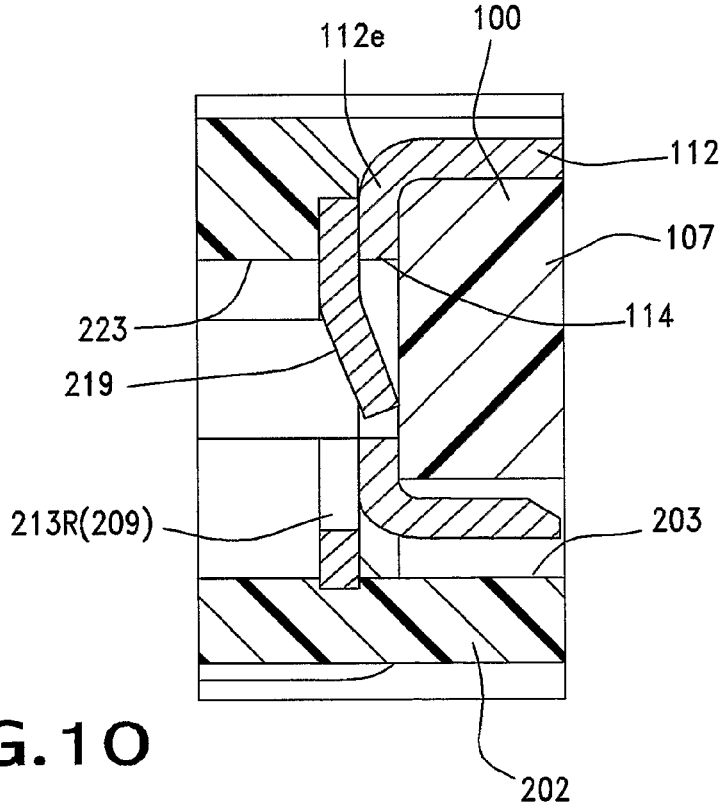
FIG. 10 is an enlarged main-portion view of FIG. 9.

As shown in FIG. 10, upon connecting the plug connector 100 to the receptacle connector 202, the inwardly bent member 219 comes into contact with the folded portion 112*e* of the upper shell 112. Accordingly, electrical noise that propagates through the outer conductor C8 of each coaxial cable C upon connecting the plug connector 100 to the receptacle connector 202 can be easily grounded to the substrate P also via the inwardly bent member 219. The path used in this case is a path from the outer conductor C8—the second cable holder 110—the pair of bent members 112*a* of the upper shell 112—the folded portion 112*e* of the upper shell 112—the inwardly bent member 219 of the metal plate 209—the rear edge surface 213R—the outwardly bent member 222—the substrate P.

An additional path for removing the electrical noise flowing in the outer conductor C8 of each coaxial cable C is the route of a ground line from the outer conductor C8—the good conductor 119—the pair of outwardly bent members 222—the substrate P. The influence of noise on the signal can be made smaller as the distance between the outer conductor C8 of each coaxial cable C and the outwardly bent members 222 becomes shorter. As a result, the influence of noise on the signal can be suppressed. In this regard, the last route is shorter than the two former routes. As described above, the upper shell 112, the metal plate 209, and the good conductor 119 serve to cause the noise flowing in each coaxial cable C to flow to the ground.

Further, upon fitting the plug connector 100 into the fitting recess 203 of the receptacle connector 202, the S-shaped receptacle-side terminals 221 undergo elastic deformation (FIGS. 4, 5), so a contact pressure is generated between the plug-side terminals 121 and the receptacle-side terminals 221.

The contact pressure causes the plug connector 100 as a whole to move towards the rear long edge wall 204R. The resulting pressurizing force acting at this time causes warpage of the rear long edge wall 204R. Further, since the release hole 232 is formed in the rear long edge wall 204R, stress concentration occurs in the rear long edge wall 204R.

In this regard, however, the rear edge surface 213R of the metal plate 209, which serves to reinforce the rear long edge wall 204R to enhance the strength of the same, functions as the support portion for the rear long edge wall 204R of the receptacle housing 207. Accordingly, the strength of the rear long edge wall 204R can be enhanced even though the release hole 232 is formed in the rear long edge wall 204R. The pair of outwardly bent members 222 constituting a part of the rear edge surface 213R are firmly fixed onto the substrate P by soldering. Accordingly, even when stress concentration occurs in the rear long edge wall 204R of the receptacle housing 207 due to the contact pressure that acts between the plug-side terminals 121 and the receptacle-side terminals 221 upon connecting the plug connector 100 and the receptacle connector 202 together, the rear long edge wall 204R can be fixed to the substrate P through the pair of outwardly bent members 222, whereby the strength of the rear long edge wall 204R can be enhanced irrespective of the presence/absence of the release hole 232.

As a result, it is possible to effectively prevent the rear long edge wall 204R and, by extension, the receptacle housing 207 from deforming. In this sense, the rear edge surface 213R including the outwardly bent members 222 can be referred to as fixing means for fixing the rear long edge wall 204R to the substrate P. The pair of outwardly bent members 222 constitute a part of the metal plate 209, and the metal plate 209 is disposed in the receptacle housing 207. Accordingly, there is no need to separately prepare the pair of outwardly bent members 222 to enhance the strength of the rear long edge wall 204R, thereby achieving improved workability and reduced number of components.

Figure 9:
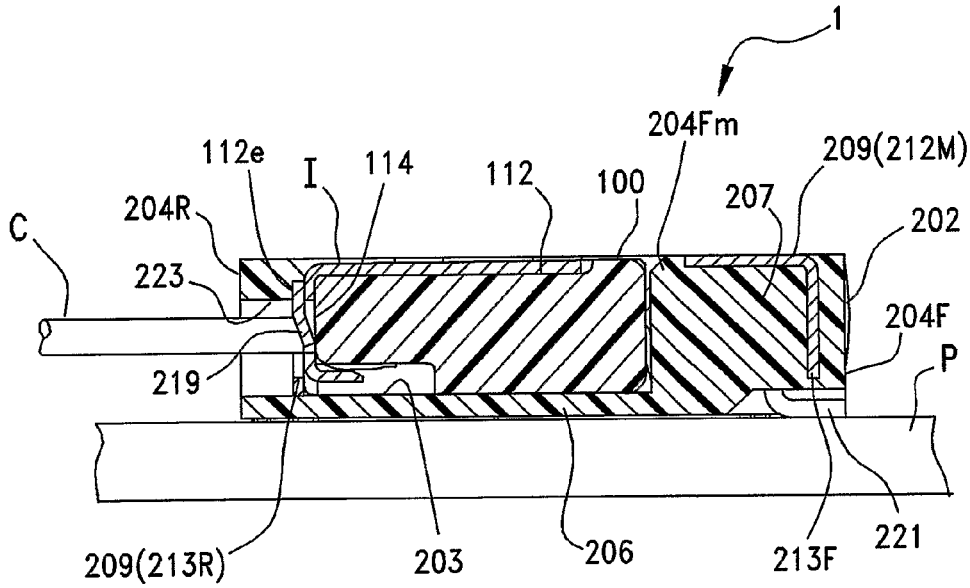
FIG. 9 is a sectional view taken along a line D-D of FIG. 3.
Figure 11:
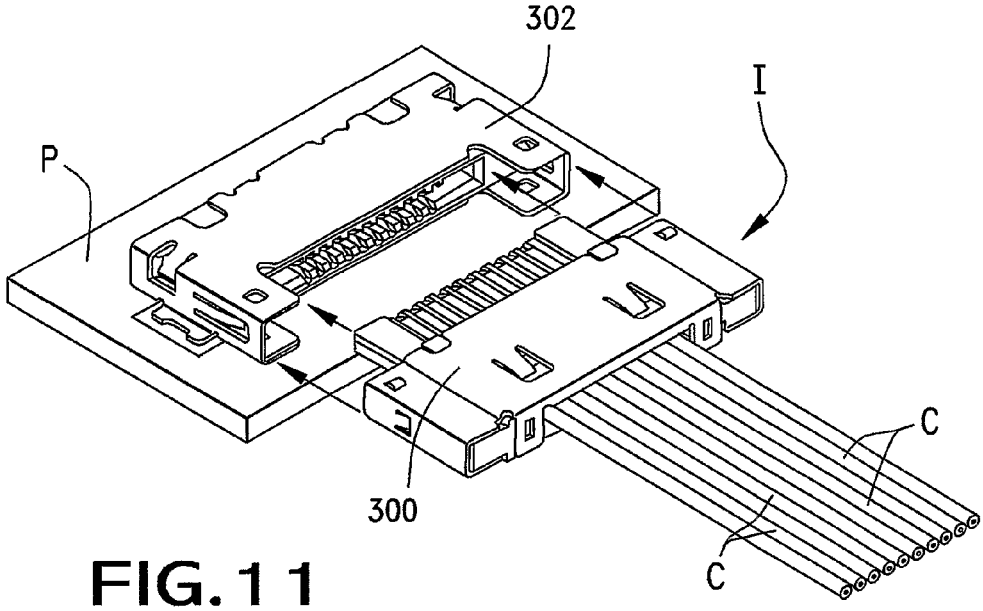
FIG. 11 (PRIOR ART)
FIG. 11 is a perspective view of a known prior art horizontal-type connector device in a state prior to connecting a plug connector to a receptacle connector.
Figure 12:
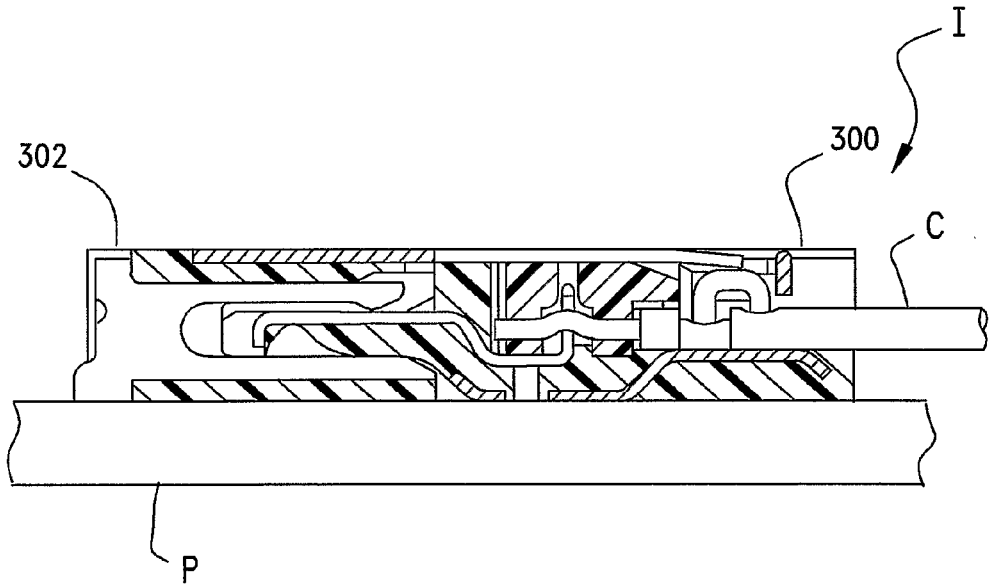
FIG. 12 (PRIOR ART)
FIG. 12 is a longitudinal sectional view showing a state in which the receptacle connector and the plug connector in the state as shown in FIG. 11 have been assembled together.
Figure 13:
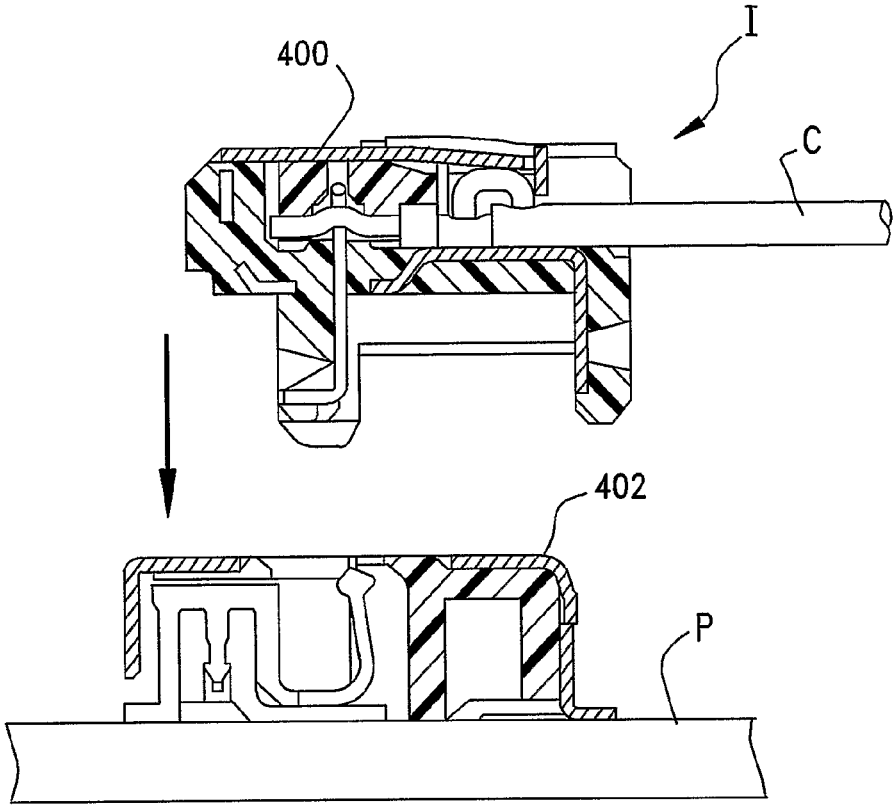
FIG. 13 (PRIOR ART)
FIG. 13 is a longitudinal sectional view of a known prior art vertical-type connector device in a state prior to connecting a plug connector to a receptacle connector.
Figure 14:
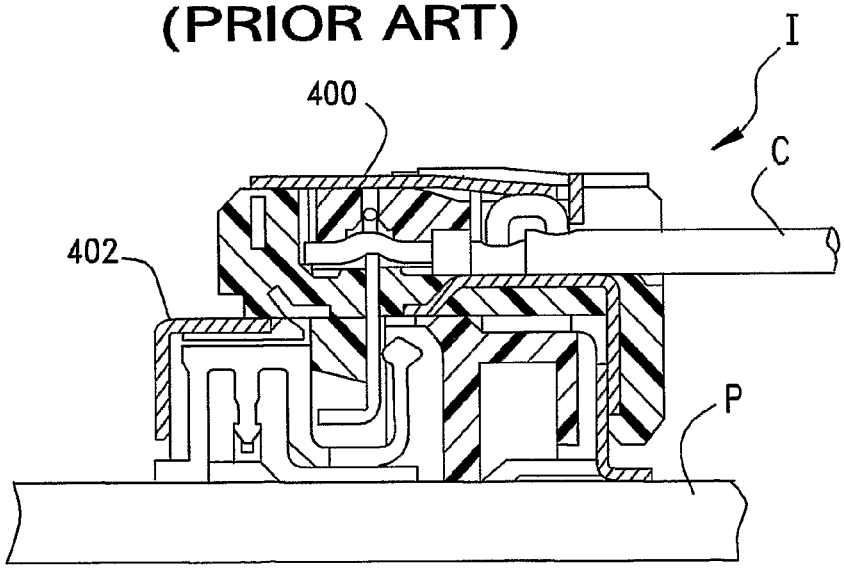
FIG. 14 (PRIOR ART)
FIG. 14 is a longitudinal sectional view showing a state in which the receptacle connector and the plug connector as shown in FIG. 13 have been assembled together.
Figure 15:
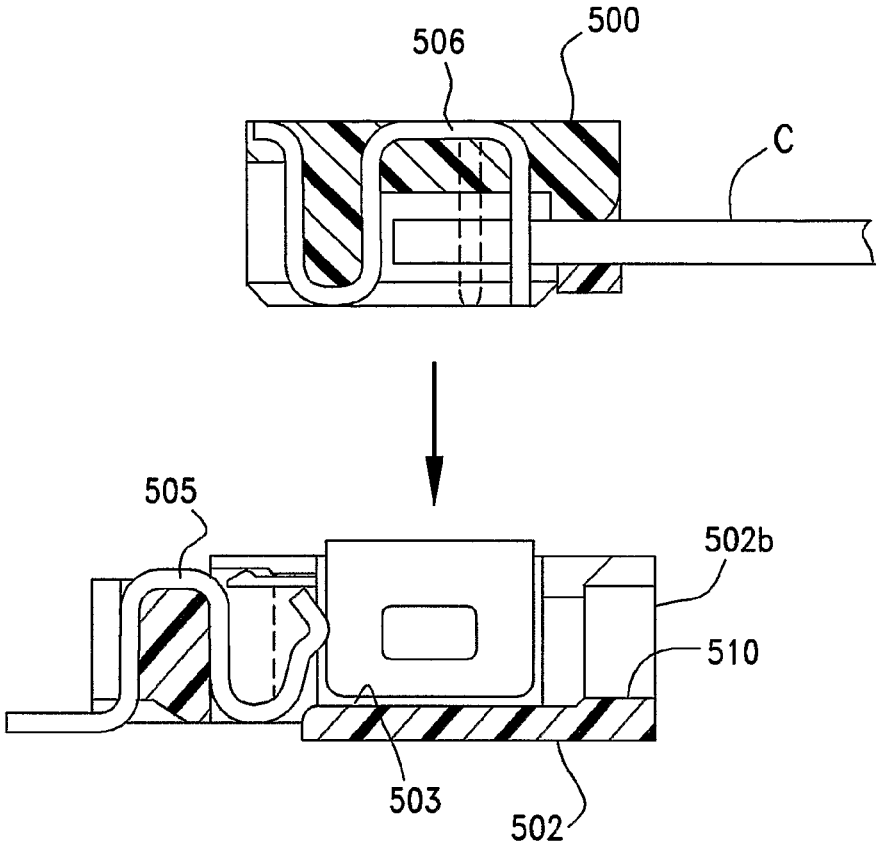
FIG. 15 (PRIOR ART)
FIG. 15 is a perspective view, illustrating another known prior art vertical-type connector device in a state prior to connecting a plug connector to a receptacle connector; and, FIG. 16 is a longitudinal sectional view showing a state in which the receptacle connector and the plug connector as shown in FIG. 15 have been assembled together.
Figure 16:
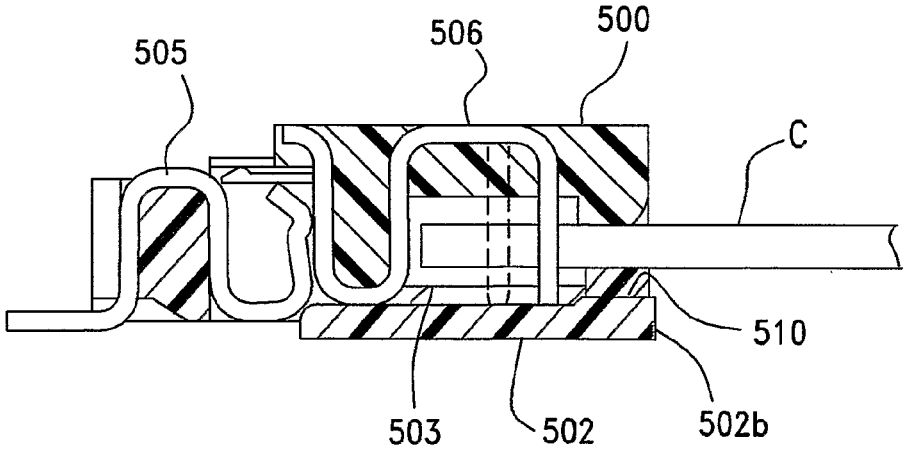
FIG. 16 (PRIOR ART)

Further, upon connecting the plug connector 100 to the receptacle connector 202, the inwardly bent member 219 is latched onto the opening 114 formed in the folded portion 112*e* of the upper shell 112, thereby making the locking between the plug connector 100 and the receptacle connector 202 secure. (FIGS. 8 & 9.) Even when the coaxial cables C are pried so a force for releasing the connection between the plug connector 100 and the receptacle connector 202 acts on the plug connector 100 and the receptacle connector 202, it is possible to prevent detachment of the plug connector 100 from the receptacle connector 202. As a result, no trouble occurs in the electrical connection. Further, the provision of the opening 114 readily allows the inwardly bent member 219 to be deeply fitted into the plug connector 100, thus making the locking together of the connectors secure. (FIG. 10.)

In addition, it is needless to mention that the present invention is not limited to the above illustrated examples but may be subject to various modifications without departing from the gist of the present invention. For example, while in the above-described embodiment the inwardly bent member 219 is provided to the receptacle connector 202 and the opening 114 onto which the inwardly bent member 219 latches is provided in the plug connector 100, the locations for disposing the inwardly bent member 219 and the opening 114 may be interchanged so that the inwardly bent member 219 is provided to the plug connector 100 and the opening 114 is provided in the receptacle connector 202.

Further, while in this embodiment each outwardly bent member 222 is formed as a part of the metal plate 209, it is also possible to provide the outwardly bent member 222 as a metal member separate from the metal plate 209 and to use the outwardly bent member 222 as fixing means which allows the electrical noise flowing in each cable C to flow to the ground and which can be used alone for mounting the rear long edge wall 204R to the substrate P.

In addition, the rear edge surface 213R having the outwardly bent members 222 may be provided not as a part of the metal plate 209 but as a separate metal member. A ground terminal that electrically connects to the substrate P may be provided to a part of the metal plate 209 that is electrically connected to the upper shell 112 to thereby remove the noise flowing in each cable C through the ground terminal.

The present invention is applicable not only to a vertical type connector but also to a horizontal type connector device. In the case of such a horizontal type connector device as well, upon connecting the connector to the mating connector, stress concentration may occur at some location of the mating connector due to a contact pressure between the plug-side terminals and the receptacle-side terminals, which is generated due to the above connection. Therefore, by firmly fixing the above-mentioned location onto the substrate by the fixing means, the location where stress concentration occurs can be fixed onto the substrate, thereby achieving enhanced strength at that location. Therefore, it is possible to prevent deformation from occurring at the location where stress concentration occurs and in the vicinity thereof.

What is claimed is:

1. A wire to board connector assembly, comprising:

a first connector including a housing and a plurality of conductive first terminals, the terminals having termination portions for terminating a single cable of a plurality of cables to a single terminal, said terminals further including contact portions extending through the first connector and positioned along a mating contact face of said first connector, and the plurality of cables extending out from one edge of said first connector housing; and, a second connector matable to said first connector, the second connector including an insulative housing supporting a plurality of conductive terminals, the second housing having an open receptacle portion that receives said first connector housing therein, said second connector housing having a cable insertion portion in the form of a slot defined along an edge thereof for receiving said cables of said first connector when said first connector housing is received within said second connector housing recess, the second connector housing further including a plurality of conductive terminals having contact portions extending along an inner edge of said recess and terminal portions extending out of said second connector housing for connection to a substrate; and said second connector further including a grounding member with contact portions that extend into said recess for connecting to at least one grounding surface of said first connector.

2. The connector assembly of claim 1, wherein said second connector includes first and second pairs of engagement members for engaging said first connector when said first connector is received within said recess, the first pair of engagement members being disposed on a first pair of opposed sides of said recess, the second pair of engagement members being disposed on a side said recess that extends between the first pair of opposed sides of said recess.

3. The connector assembly of claim 1, wherein said first connector includes a metal wire clamp on contact with ground shields of said cable for directing electrical noise which flows in the cable to flow to a ground connection of said second connector upon connecting the first connector to said second connector. cable to flow to ground.

4. The connector assembly of claim 1, wherein said second connector second engagement members are disposed on said recess on opposite sides of said cable insertion portion.

5. The connector assembly of claim 1, wherein said cables each include a conductive shield, and said first connector includes a first clamp formed of a conductive material that contacts said cable conductive shields and electrically connects all of said cable conductive shields together.

6. The connector assembly of claim 5, wherein said second connector further includes a second clamp formed of an insulative material, the second clap retaining said cables in place within said first connector housing and exerting a pressure onto said cables against said first connector terminal termination portions.

7. The connector assembly of claim 1, wherein said second connector grounding member further includes a latching portion for latching said first connector and second connector together.

8. The connector assembly of claim 7, wherein the latching portion includes an elastic member that latches onto the first connector, and that first mating connector is provided with an opening into which the elastic member is fitted.

9. The connector assembly of claim 8, wherein said first connector housing includes a metal plate for causing electrical noise flowing in the cable to flow to ground.

10. A receptacle connector, comprising:

an insulative housing and a plurality of conductive terminals supported by the housing, said housing include an open, four-sided recess dimensioned to receive a connector housing of a mating connector therein second connector matable to said first connector;

a plurality of conductive terminals supported by said housing, the terminals including tail portions extending out of said connector housing for connection to a supporting substrate and contact portions that extend into the recess, the terminal contact portions being arranged along one of said four sides of said recess, said terminals having a S-shaped configuration between the tail and contact portions; and, a conductive support member that encircles said recess, the support member including a first pair of engagement arms that are positioned so as to extend into said recess from two opposing sides thereof, said support member further including a pair of second engagement arms, said connector housing further including a slot formed on one of said four sides, the slot defining an opening which receives a plurality of wires attached to an opposing mating connector received within said recess, said slot being disposed in a side of said recess and extending between said second engagement arms.

11. A plug connector for mating a plurality of wires to contacts of a mating receptacle connector, the receptacle connector being of the type that has a housing with a vertically-oriented recess defined therein so that the plug connector is mated therewith by inserting it into the recess in a vertical direction, each of the wires including a center conductor, and inner insulating sheath, an outer conductive shield and an exterior insulative sheath, the plug connector comprising, in combination:

an insulative housing having a base portion that supports a plurality of insulation displacement terminals, the terminals having wire termination portions disposed within said plug connector housing and contact portions that extend along an exterior surface of said plug connector housing;

a first wire clamp formed of an insulative material, the first wire clamp being supported by said plug connector housing, said first wire clamp pressing a plurality of wires down in said plug connector housing so that the center conductors of said wires are brought into contact with said terminal termination portions;

a second wire clamp formed from a conductive material, the second wire clamp also being supported in said plug connector housing, said second wire clamp making contact with the outer conductive shields of said wires, the second wire clamp extending in a direction within said plug connector housing that is perpendicular to said wires.

12. The plug connector of claim 11, further including a conductive n exterior shell disposed on and surrounding a portion of said plug connector housing, and said second wire clamp includes an exterior conductive surface which the exterior shell contacts.

* * * * *